US005553990A

United States Patent [19]

Kytola, Sr.

[11] Patent Number: 5,553,990

[45] Date of Patent: Sep. 10, 1996

[54] HYDRAULIC WHEELCHAIR LIFT

[76] Inventor: David Kytola, Sr., 8300 Phillips Rd. SW., Apt. 44, Tacoma, Wash. 98498

[21] Appl. No.: 515,467

[22] Filed: Apr. 27, 1990

[51] Int. Cl.[6] ..... B66F 7/16

[52] U.S. Cl. ..... 414/659; 182/62.5; 182/146; 414/592; 414/662; 414/921

[58] Field of Search ..... 182/62.5, 146; 414/592, 921, 495, 537, 541, 659, 662, 663, 282; 187/9 R, 73, 80, 95, 17; 14/11.5

[56] References Cited

U.S. PATENT DOCUMENTS

| | | | |
|---|---|---|---|
| 3,473,774 | 10/1969 | Riblet | 182/146 |
| 4,081,091 | 3/1978 | Thorley | 414/921 X |
| 4,124,130 | 11/1978 | Rohrs et al. | 414/921 X |
| 4,457,402 | 7/1984 | Del Vecchio et al. | 414/921 X |
| 4,467,894 | 8/1984 | Sinclair | 187/17 |
| 4,479,753 | 10/1984 | Thorley | 187/9 R X |
| 4,576,539 | 3/1986 | Williams | 187/17 X |
| 4,787,111 | 11/1988 | Pacek et al. | 414/921 X |
| 4,804,308 | 2/1989 | Hamblin et al. | 414/537 X |
| 4,988,262 | 1/1991 | Gines | 414/282 X |
| 5,015,140 | 5/1991 | Kling | 414/663 X |
| 5,026,244 | 6/1991 | Dorn | 414/921 X |
| 5,040,936 | 8/1991 | Rhea | 414/921 X |

FOREIGN PATENT DOCUMENTS

| | | | |
|---|---|---|---|
| 0186541 | 11/1982 | Japan | 414/921 |
| 0460286 | 9/1968 | Switzerland | 182/62.5 |

*Primary Examiner*—Michael S. Huppert
*Assistant Examiner*—James Keenan
*Attorney, Agent, or Firm*—Christensen, O'Connor, Johnson & Kindness

[57] ABSTRACT

Wheelchair lift (10) includes a platform (12) mounted on a carriage (14) for vertical travel between the ground and an elevated location along a mast structure (16) through the use of a linear, lift actuator (18). Platform (12) includes an upper main section (20) and a lower movable section (22) that is horizontally extendible and retractable by a linear, platform actuator (24). The actuators (18) and (24) are cooperatively interconnected with and controlled by a power system (28) so that platform (12) is raised to a desired height before the movable section (22) is extended, and conversely the movable section (22) is fully retracted before the platform (12) is allowed to lower to the ground.

1 Claim, 5 Drawing Sheets

HYDRAULIC WHEELCHAIR LIFT

FIELD OF THE INVENTION

The present invention relates to a wheelchair lift, particularly to a lift which is capable of being operated by a disabled person for purposes of gaining access to elevated areas, and more particularly to a lift adapted to a stairway of a public facility so that the stairway may be conveniently used by the disabled, while preserving access for the non-disabled to the stairway.

BACKGROUND OF THE INVENTION

Lifting devices, such as wheelchair lifts, are used in a variety of applications, including incorporation into buses and at public facilities, to provide access for the disabled, such as the handicapped or elderly, particularly those in wheelchairs. Such devices typically have required a significant dedication of space. For example, prior lifts may block an entire stairway during use, and must be removed so that the stairway may be used by non-disabled persons. It would be advantageous therefore to provide a lift which did not entirely obscure a stairway or other passageway, during use of the lift, and which, when not in use, permitted the entire stairway to be utilized. In addition, the disabled or handicapped person would benefit from a lift which he or she could operate safely and enter and exit without requiring the assistance of others, thus permitting greater independence.

SUMMARY OF THE INVENTION

The present invention concerns a lift adapted to be operated by a disabled person for gaining access to elevated areas, including transit vehicles. The lift includes a horizontal lift platform mounted on a carriage for vertical travel on an upright mast structure between the ground and an elevated location. The lift platform is raised and lowered by a linear lift actuator incorporated in the mast structure. The lift platform includes a main section and a movable section that is horizontally extendible and retractable relative to the main section by a linear, platform actuator. The lift actuator and the platform actuator are operably interconnected by a power supply and control system to operate the actuators in a raise and extension sequence wherein the lift platform is raised to a desired height before the platform actuator is activated to extend the movable section to interconnect the main deck with the steps or other elevated location. Conversely, the power supply and control system controls the lift and platform actuators in a retract and lower sequence wherein the platform movable section is retracted within the confines of the main platform section before the platform is allowed to lower to the ground. In accordance with the present invention the power and control system for the actuators includes first and second control valves connected in fluid flow communication between a source of pressurized fluid and the lift and platform actuators. During the raise and extension sequence, the first and second control valves direct pressurized fluid initially to the lift actuator to raise the platform. After the platform has been raised to a desired height, the two control valves direct pressurized fluid to the platform actuator to extend the movable section of platform. During the retract and lower sequence, the control valves direct pressurized fluid initially to the platform actuator to retract the movable section of the platform while simultaneously preventing fluid from discharging from the lift actuator thereby maintaining the lift platform in raised position. After retraction of the movable section, the control valves direct pressurized fluid to the lift actuator to lower the platform.

The mast structure includes a pair of elongate, upright guide members, and the carriage includes cuffs which surround the mast guide members to guide the carriage for travel therealong. The interior size of the cuffs are slightly larger than the exterior size of the guide members, whereby the load of the lift platform nominally tilts the cuffs relative to the guide members to generate a frictional resistance between the cuffs and the guide members which prevents downward movement of the carriage along the guide members unless the lift actuator is operated. At least one roller assembly is mounted on each cuff to facilitate the travel of the carriage along the mast structure. Each of the roller assemblies includes at least one roller disposed above its corresponding cuff in rolling contact with the guide member during the raising of the lift platform. The contact pressure of the roller against the guide member may be selectively varied. As the carriage is lifted by the lift actuator, the rollers "lead" the cuffs and, thus, guide and "center" the cuffs relative to the guide members. As a result, minimal friction resistance exists between the cuffs and the guide members during the raising of the lift platform.

In accordance with a further aspect of the present invention, the lift platform may be supported by a pair of mast structures located on opposite sides of the platform. Each of the mast structures includes a lift actuator for raising and lowering the platform. The use of a pair of mast structures enables the lift to be free-standing rather than being cantilevered from a single mast structure.

According to another aspect of the present invention, the lift platform may be constructed from two or more horizontally movable sections. Appropriate means are provided to interconnect the movable sections of the lift platform to extend and retract the movable sections relative to the platform in a telescoping manner. Constructing the lift platform with telescoping movable sections enables the platform to be used for longer horizontal reaches; for instance, in conjunction with a higher flight of stairs.

BRIEF DESCRIPTION OF THE DRAWINGS

Illustrative embodiments of the present invention are depicted in the drawings, in which.

DETAILED DESCRIPTION OF THE INVENTION

Figure 1:
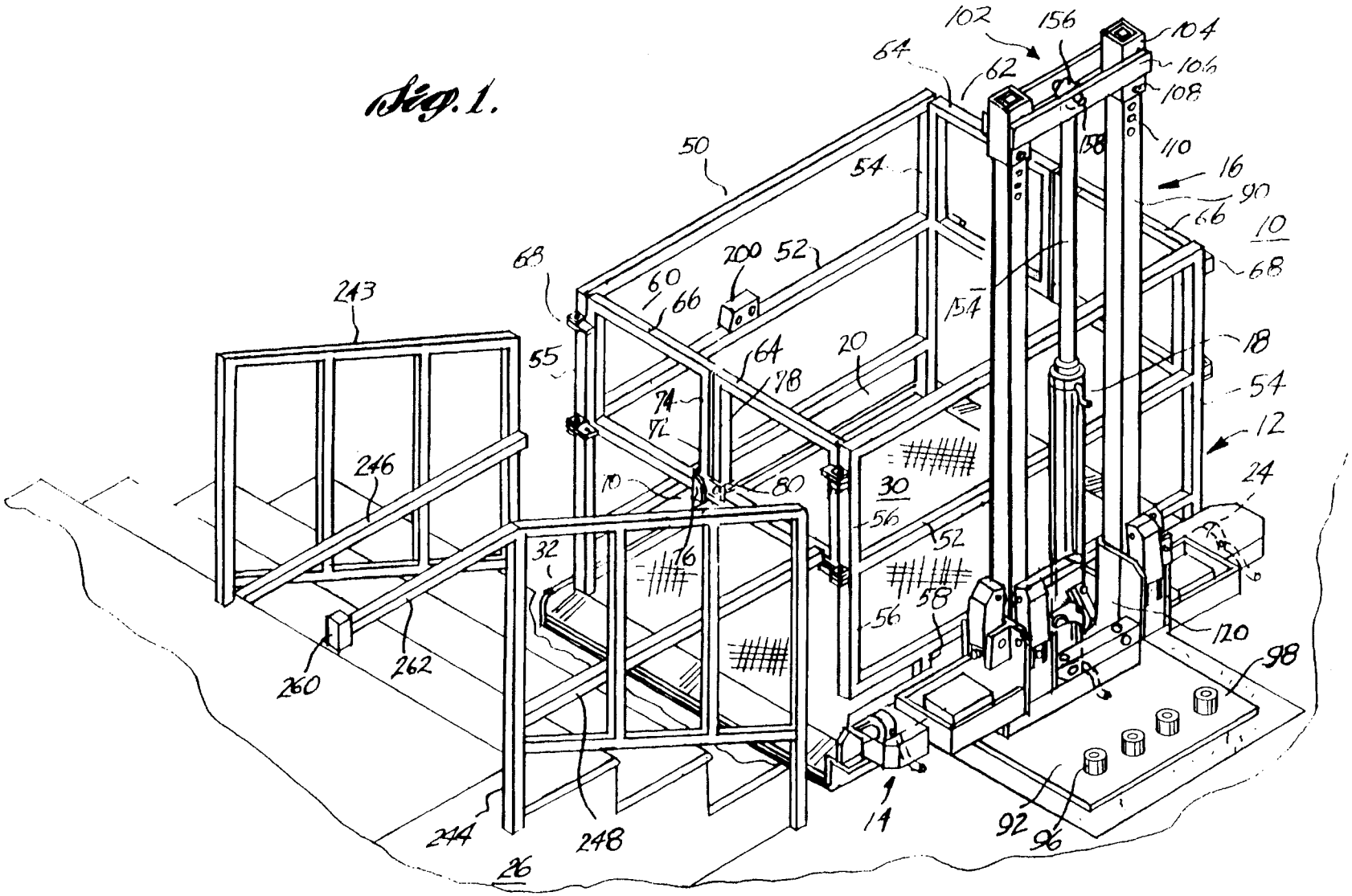
FIG. 1 is an isometric view of the lift of the present invention shown with the lift platform in lowered position.

Lift 10 constructed in accordance with the present invention in basic form includes a platform 12 mounted on a carriage 14 for vertical travel between the ground G and an elevated location along a mast structure 16 through the use of a linear, lift actuator 18 interconnected between the carriage and the top of the mast structure. Platform 12 includes a main section 20 and a movable section 22 that is horizontally extended and retracted by a linear, platform actuator 24. The actuators 18 and 24 are cooperatively interconnected with and activated by a power supply system 28 that controls the operation of the actuators so that platform 12 is raised to a desired height, e.g., to the top of steps 26, before platform actuator 24 is activated to extend the movable section 22 for interconnecting the main deck 20 with the top of the steps or other elevated location. Conversely, the power supply system 28 operates and controls the actuators 18 and 24 in such a manner that the platform movable section 22 is retracted within the confines of the main section 20 before the platform 12 is allowed to lower to the ground G.

Figure 2:
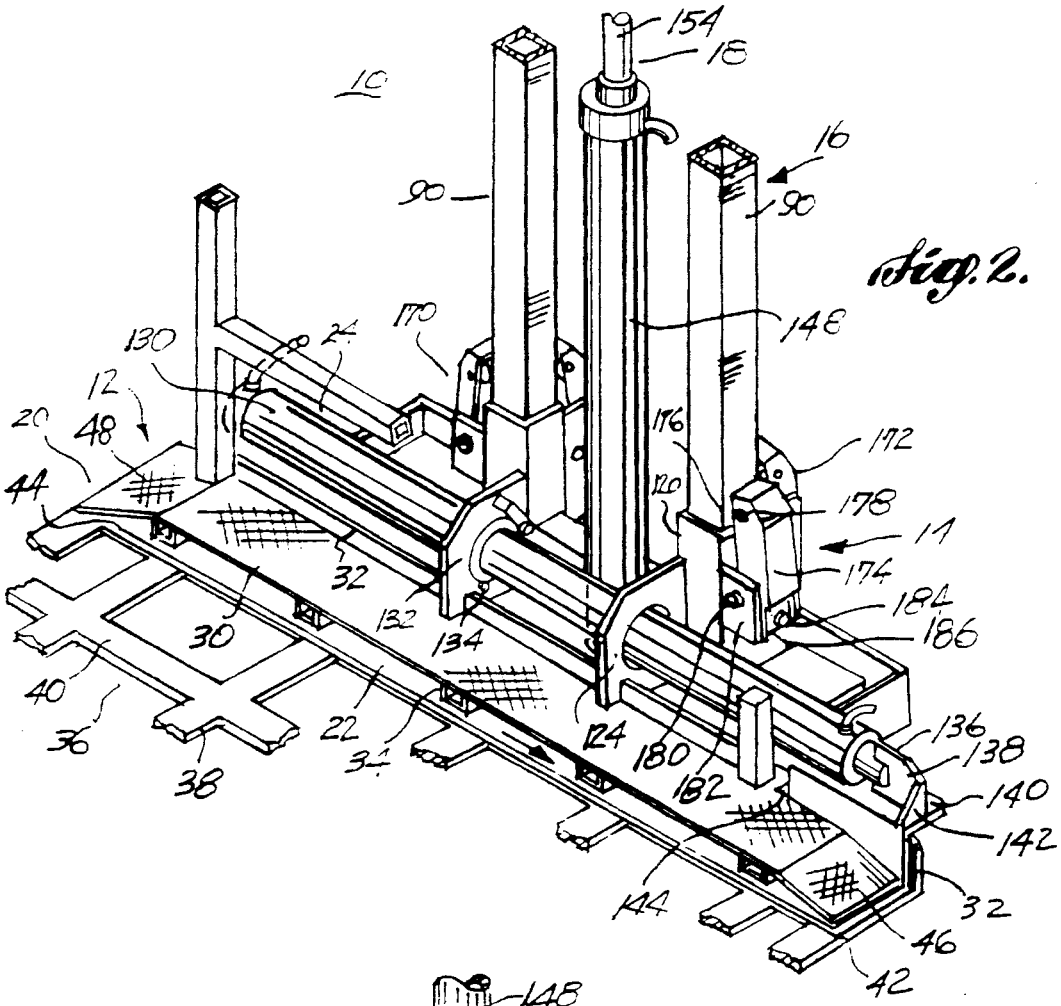
FIG. 2 is an enlarged, fragmentary, isometric view of the lift shown in FIG. 1 specifically illustrating the construction of the carriage and lift platform.
Figure 3:
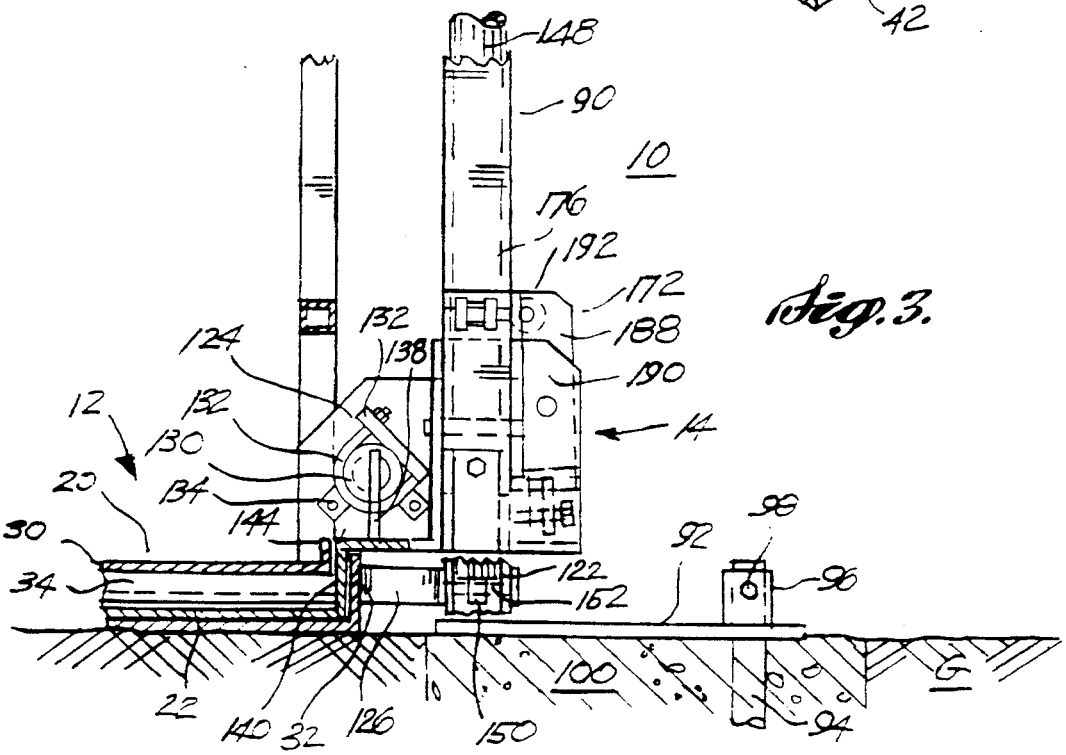
FIG. 3 is an enlarged, fragmentary side elevational view of the present invention taken substantially along lines 3—3 of FIG. 2 with portions of the lift platform shown in cross section for clarity.
Figure 4:
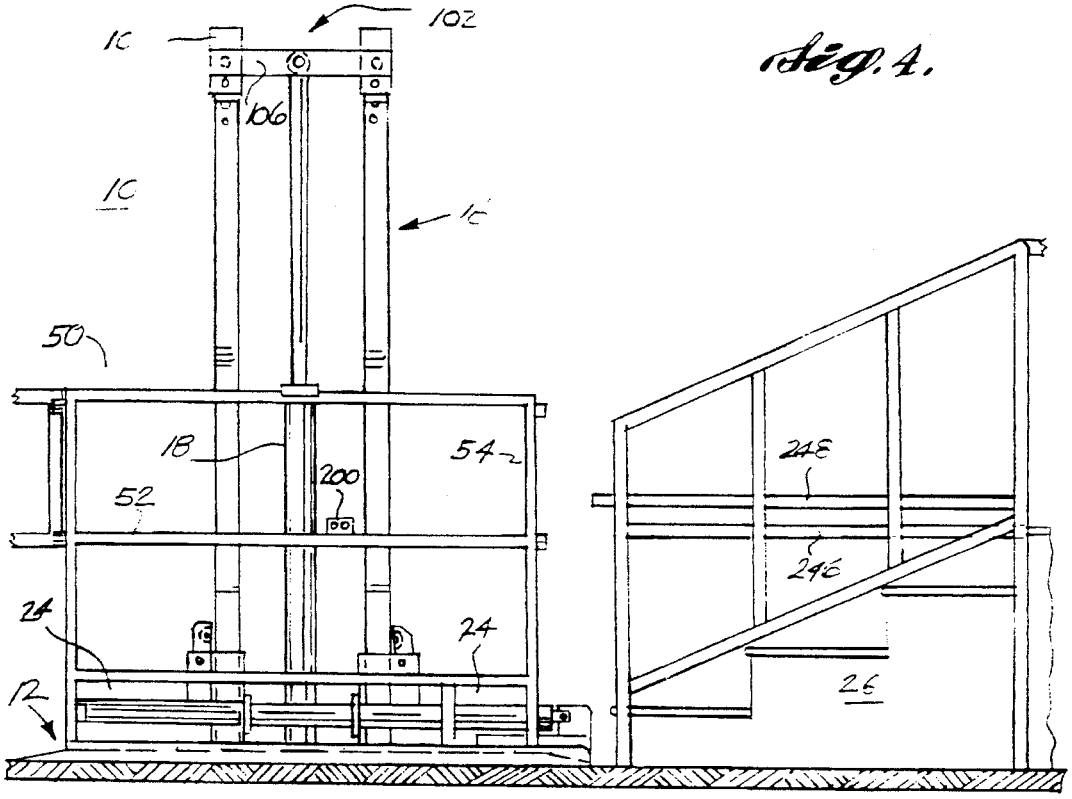
FIG. 4 is a front elevational view of the lift illustrated in FIG. 1 with the lift in lowered position and the platform in retracted position.
Figure 5:
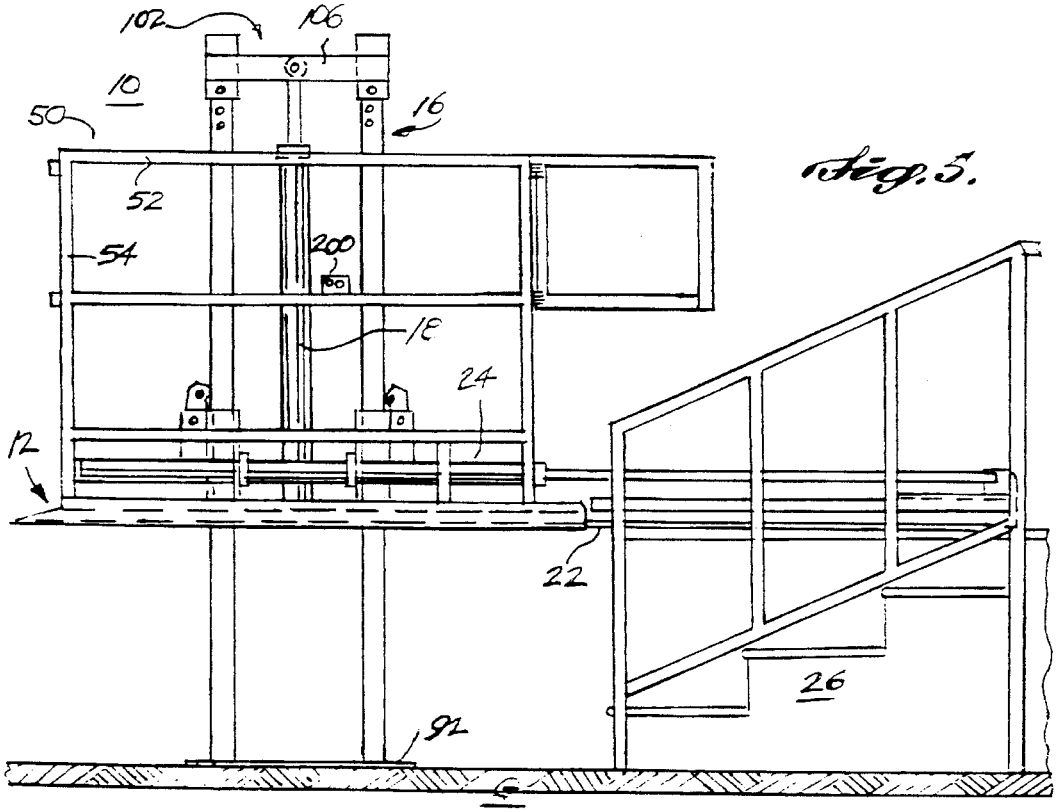
FIG. 5 is a view similar to FIG. 4, but with the lift in raised position and the platform in extended position;.

Solely to assist in the description of the present invention, with respect to platform 12, the "front" or "forward portion" of the platform is defined as the portion to the right side in FIGS. 2, 4 and 5 (the left side in FIG. 1) and, thus, the "rear" or "rearward portion" of the platform is defined as the portion to the left side in FIGS. 2, 4 and 5 (right side in FIG. 1). Also, with respect to the carriage 14 and the mast structure 16, the "front" or "forward direction" is defined as in the left-hand direction in FIG. 3, and the "rear" or "rear direction" is defined as in the right-hand direction in FIG. 3.

Next, considering the above aspects of the present invention in greater detail, as most clearly shown in FIGS. 1, 2 and 3, platform 12 is constructed with a main section 20 having generally rectangularly-shaped, flat deck 30 bordered by side edge plates 32 that extend above and beneath the upper and lower surfaces of the deck. Preferably, the width of the deck 30 is sufficient to conveniently receive a wheelchair, while being narrower than the width of most stairs, such as stairs 26. This enables the stairs 26 to be used in a regular manner even during the operation of lift 10. Also, deck 30 is of a length sufficient to accommodate a wheelchair. Although one primary purpose of lift 10 is to function as a wheelchair lift, it will be appreciated that if the lift is employed for other purposes, the length and width of the deck 30 may be altered for such purposes.

A series of joist members 34 span between the edge plates 32 beneath deck 30 to underlie and support the deck. In one preferred embodiment of the present invention, the joist members are composed of U-shaped channels with the flanges of the channels fixedly secured to the bottom surface of the deck 30, for instance by welding, thereby to cooperatively form a box section with the deck. It is to be understood that the joist members can be formed in other shapes and from other types of structural members, such as rectangular tubing, without departing from the spirit or scope of the present invention.

As most clearly illustrated in FIG. 2, a gridwork 36 underlies joist members 34 and is attached to edge plates 32 to support the platform movable section 22 which lies thereon. Preferably, the gridwork 36 is composed of a series of spaced-apart, interconnected, flat, transverse bars 38 and longitudinal bars 40; however, the gridwork may be constructed from other structural members or may consist of a single plate, without departing from the spirit or scope of the present invention. Ideally, the transverse bars 38 of gridwork 36 that span between edge plates 32 are not positioned exactly perpendicularly to the edge plates, but rather are slightly askewed at an angle $\alpha$ from the perpendicular so that the leading and trailing edges 42 and 44 of the platform movable section 22 progressively intersect with the transverse bars 38 rather than simultaneously intersecting with the entire length of the transverse bars, thereby facilitating the travel of the movable section over gridwork 36 without obstruction. A ramp 46 is provided at the forward edge portion of deck 30 to provide a smooth transition between the deck and the underlying movable section. Likewise, a ramp 48 is provided at the rearward portion of deck 30 to provide a smooth transition between the deck and the ground G. It will be appreciated that ramps 46 and 48 facilitate the entry of wheeled vehicles, such as wheelchairs, onto and off of platform 12.

Side rail structures 50 are provided on each side of platform 12 to prevent lift occupants or cargo from accidentally falling off the platform. In one preferred embodiment of the present invention, as illustrated in FIGS. 1, 4 and 5, the side rail structures 50 are constructed from a series of horizontally extending, vertically spaced-apart runners 52 that intersect corner posts 54 extending upwardly from three of the four corners of deck 30. The fourth post 56 that is located above the forward edge of deck 30 adjacent platform actuator 18 extends upwardly from the lowermost runner 52 to the uppermost runner 52. A short post 58 extends upwardly from deck 30 to the underside of the lowermost runner 52 at a location spaced rearwardly from the forward end of the runner.

Forward and rearward gates 60 and 62 are mounted on the side rail structures 50, also to prevent accidental disembarkment from platform 12. The gates 60 and 62 are each composed of a pair of rectangularly-shaped perimeter frame structures 64 and 66 mounted on corresponding posts 54 and 56 with hinge assemblies 68. A manually operable latch 70 is provided to close gates 60 and 62. As most clearly shown in FIG. 1, latch 70 is composed of a bar 72 pivotally mounted on upright member 74 of frame 66 to engage a hasp 76 mounted on upright member 78 of gate frame 64. A manually graspable pin 80 is removably engageable into a close-fitting opening formed in the free end portion of bar 72 extending beyond upright member 78 so that when the pin is engaged with the bar, the pin strikes against the upright member 78 when attempting to rotate bar 72 counterclockwise, as shown in FIG. 1, into open position. Ideally, latch 70 is mounted on gates 60 and 62 at an elevation above deck 30 to be conveniently operable by a wheelchair occupant. It will be appreciated that gates 60 and 62 and latch 70 may be of numerous other constructions without departing from the spirit or scope of the present invention.

Additionally referring to FIGS. 2 and 3, the mast structure 16 is composed of a pair of elongate, vertically extending guide members 90 disposed in spaced, parallel relationship to each other. The lower ends of the guide members 90 are fixedly attached to a baseplate 92 anchored to the ground by a plurality of anchor tubes 94 extending downwardly through close-fitting collars 96 welded or otherwise affixed to the upper surface of the baseplate 92. Retaining pins 98 extend transversely through aligned holes formed in collars 96 and anchor tubes 94 to maintain the anchor tubes in engagement with the collars. Ideally, the anchor tubes 94 are securely anchored within a concrete pad 100 underlying baseplate 92. It will be appreciated that if lift 10 is placed on a floor structure, such as within a building, that baseplate 92 may be securely attached to the floor structure by well-known techniques.

As most clearly shown in FIGS. 1, 4 and 5, the upper ends of guide members 90 are interconnected by a crosshead assembly 102 composed of close-fitting collars 104 extending over the upper end portions of the guide members 90 and a pair of crossplates 106 transversely interconnecting and fixedly attached to the collars 104. Retention pins 108 extend transversely through aligned holes formed in collars 104 to engage through selected cross openings 110 formed in the upper end portion of guide members 90. As explained more fully below, the elevation to which platform 12 may be raised by lift actuator 18 may be altered by changing the particular cross openings 110 through which retention pins 108 are engaged.

Guide members 90 are illustrated in the drawings as composed of square tubular material. Such material is readily commercially available and has the advantage of being of substantially high strength relative to its weight. However, it is to be appreciated that the guide members 90 may be constructed from other cross-sectional shapes and other types of materials, such as channels or solid stock material, without departing from the spirit or scope of the present invention. It will be appreciated that the construction of collars 104 may be readily adapted to accommodate the particular external shape and size of guide members 90.

As perhaps most clearly shown in FIGS. 1–3, carriage 14 is composed of sleeves or cuffs 120 closely engaged over guide members 90 to slide along the guide members as platform 12 is raised and lowered. At their lower ends, the cuffs 120 are interconnected by a pair of crossplates 122, FIG. 3, in a manner similar to the manner in which crossplates 106 transversely interconnect the upper ends of the guide members. Carriage 14 is interconnected to platform 12 by a pair of planar mounting ears 124 extending laterally from cuffs 120 to intersect the adjacent deck edge plate 32 and the top surface of deck 30. In addition, a pair of diagonally disposed brackets 126 interconnect each cuff 120 with the adjacent side edge plate 32, FIG. 3. The brackets 126 extend from the cuffs 120 diagonally toward the forward and rearward ends of platform 12. It will be appreciated by the foregoing that structure platform 12 is rigidly mounted on carriage 14. It will also be appreciated that the carriage 14 could be constructed so that the platform 12 is readily detachable from the mast structure to enable the lift to be shipped in a more compact manner. This could be accomplished by making the cuffs 120 detachable from the deck plate 32 by any appropriate manner.

As most clearly shown in FIGS. 1–3, a linear platform actuator 24 is employed to extend and retract the movable section 22 of platform 12. Preferably, actuator 24 is powered by a fluid, such as air or hydraulic oil. In the embodiment of the present invention shown in the drawings, actuator 24 is composed of a hydraulic cylinder assembly 130 extending through clearance openings formed in mounting ears 124 and secured to the ears by clamping assemblies 132 that encircle the cylinder assembly 130 at locations adjacent the sides of the ears that face each other. The clamping assemblies 132 are secured to corresponding mounting ears 124 by fasteners, such as capscrews 134, extending through clearance openings formed in the clamping assemblies to engage within tapped holes formed in the mounting ears. The forward end of a piston rod 136 of cylinder assembly 130 is secured to an upright ear plate 138 which extends upwardly from an angle-shaped bracket 140 having a horizontal section underlying ear plate 138 and a vertical section extending downwardly to interconnect with the adjacent edge portion of the movable section 22 of platform 12. A triangular gusset plate 142 interconnects the forward end of plate 138 with the upper surface of the horizontal section of angle bracket 140. As most clearly illustrated in FIGS. 2 and 3, a notch 144 is provided in the adjacent portions of deck 30 and forward ramp 46 to provide clearance for angle bracket 140. It will be appreciated that the retracted position of platform movable section 22 relative to deck 30 (and thus also the fully extended position of the platform movable section relative to the deck 30) may be varied by adjusting the locations at which clamp assemblies 132 engage cylinder assembly 130 by simply loosening the clamp assemblies and then longitudinally sliding the cylinder assembly relative to the clamp assemblies.

As with linear actuator 24, lift actuator 18 is illustrated as being in the form of a hydraulic cylinder assembly 148 disposed centrally between guide members 90. An apertured mounting ear 150 extends downwardly from the lower end of cylinder assembly 148 and between crossplates 122. A cross pin 152 extends through aligned holes formed in the crossplates 122 and through an aperture provided in ear 150, thereby to attach the lower end of the cylinder assembly 148 to carriage 14. Cylinder assembly 148 includes a piston rod 154 extending upwardly therefrom to terminate at an enlarged, circular rod end 156 having a central opening for receiving a cross pin 158 which also extends through aligned openings formed in crossbars 106.

The stroke of cylinder 148 may be adjusted by changing the location of crosshead assembly 102. This is accomplished by removing retention pins 108 from collars 104 and then raising or lowering the crosshead assembly to a new location and then reinserting the retention pins. It can be appreciated that the height by which crosshead assembly 102 is raised or lowered results in a corresponding change in the uppermost elevation to which platform 12 may be raised.

It is to be understood that although lift actuator 18 and platform actuator 24 have been described and illustrated as being in the form of hydraulic cylinders, they can be powered by other fluids such as compressed air, or even be of other types of construction, for instance, in the form of a rack and pinion.

As carriage 14 is raised by actuation of hydraulic cylinder 148, the carriage is guided along members 90 by side roller assemblies 170 and rear roller assemblies 172. The side roller assemblies 170 are constructed in the form of an elongate, generally upright, channel-shaped roller housing 174. A pair of rollers 176 are antifrictionally mounted on the upper end portion of housing 174 by an axial in the form of a cross pin 178 extending through the center of rollers 176 and through aligned openings formed in sidewalls of housing 174. The rollers bear against the adjacent sidewall of guide member 90 located slightly above the upper edge of cuff 120. The lower portion of housing 174 is pivotally mounted on cuff 120 by a cross pin 180 which extends through aligned openings formed in a pair of flat mounting ears 182 spaced apart in parallel relationship to each other at a width slightly greater than the width of roller housing 174. The bearing pressure that rollers 176 exert against guide member 90 is controlled by adjustment of a threaded pin 184 that threadably engages with an aperture formed in a cross-plate 186 that spans between mounting ears 182 at a location below roller housing 174. The leading end of threaded pin 184 bears against the adjacent wall of cuff 120. It will be appreciated that as pin 184 is rotated in a clockwise direction shown in FIG. 2, housing 174 is pivoted about pin 180 in the counterclockwise direction, thereby increasing the bearing pressure placed on guide member 90 by rollers 176.

The construction and adjustment of rear roller assemblies 172 is essentially the same as side roller assemblies 170 and, thus, a detailed description of such construction and operation will not be repeated with the exception of the following. The housings 188 of the rear roller assemblies are somewhat longer in length than housings 174 of side roller assemblies 170. Also, rear roller assemblies 172 are mounted on mounting ears 190 extending rearwardly from cuffs 120 in spaced parallel relationship to each other.

As carriage 14 is lifted by actuation of lift cylinder assembly 148, rollers 176 of side roller assemblies 170 and rollers 192 of rear roller assemblies 172 "lead" cuffs 120 and thus guide and "center" the cuffs relative to guide members 90. As a result, minimal friction resistance exists between the cuffs 120 and the guide members 90. However, when the extension of the cylinder assembly 148 is terminated, the cuffs 120 tend to wedge or bind against guide members 90 due to the eccentric loading on cuffs 120 existing by virtue of the fact that the centroid of the combined load of the platform 12 and the carriage 14 is offset in the direction forwardly of mast structure 16. Applicant has found that by providing a total clearance of about 0.035–0.040 inches in the fore-and-aft direction between the interior of cuff 120 and the exterior of guide members 90, platform 12 will remain stationary at an elevated position on mast 16 when a lifting force or a lowering force is not being applied to the platform by hydraulic cylinder assembly 148, even if the platform is loaded to its maximum capacity. To lower platform 12, cylinder assembly 148 must be actuated in the reverse direction, i.e., to extend the hydraulic cylinder assembly.

Figure 6:
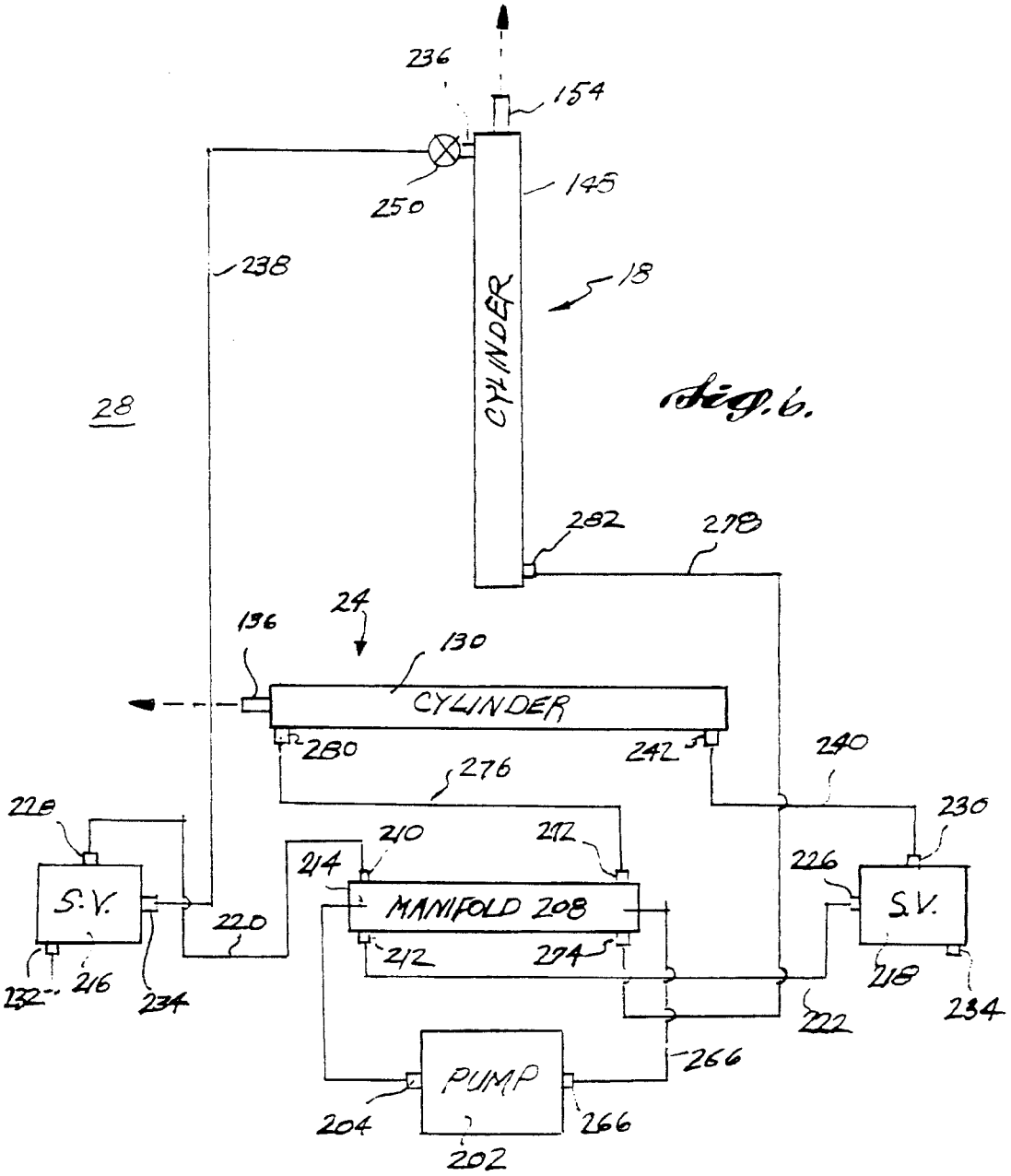
FIG. 6 is a schematic of the hydraulic system employed in the present invention.

Additionally referring to FIG. 6, this figure shows a schematic of a power supply system 28 to operate and control lift and platform actuators 18 and 24. In that the lift and platform actuators 18 and 24 are illustrated as being in the form of hydraulic cylinder assemblies 148 and 130, respectively, power supply system 28 is in the form of a hydraulic system. The construction and operation of the hydraulic system 28 will be described in conjunction with the following description of the operation of lift 10.

In the operation of lift 10, in the "lift and extend" mode, for instance, to lift a passenger and/or cargo from the ground G shown in FIG. 4 to the top of steps 26, as shown in FIG. 5, gate 60 at the entry end of platform 12 (left side shown in FIG. 4) is opened by manual operation of latch 70. After closure of the gate, an electrical switch 200, mounted on the side rail structure 50 adjacent mast 16 (FIG. 4), is actuated. A standard, commercially available electrical switch, not shown, can be employed in conjunction with gates 60 and 62 to prevent the operation of switch 200 if both of the gates are not in fully closed position. With reference to FIG. 6, the operation of switch 200 activates a hydraulic fluid pump 202 causing the pump to deliver pressurized hydraulic fluid through an outlet port 204 and to a tee 206 incorporated into one end of an elongate bar 208 spanning between the mounting ears 190 which support rear roller assemblies 172, FIG. 1. An illustrative, but nonlimiting, example of a commercially available hydraulic pump that may be used in conjunction with the present invention is the Delta Model B41154 pump. The tee 206 is formed in bar 208 by drilling a first cross hole entirely through the bar corresponding to outlet ports 210 and 212 and a second cross hole transversely thereto corresponding to inlet port 214 to intersect the first cross hole. Of course, rather than utilizing tee 206, a standard hydraulic tee fitting may be employed. Pressurized hydraulic fluid from outlet ports 210 and 212 is transmitted to a sequence valve 216 associated with the lift actuator 18 and a sequence valve 218 associated with platform actuator 24 through lines 220 and 222, respectively. Sequence valves 216 and 218 each have a high pressure inlet port 224 and 226, respectively, and a low pressure inlet port 228 and 230, respectively.

Sequence valve 216 is adjusted so that when relatively low pressure hydraulic fluid, a pressure of about 1200 psi, is applied to port 228, the hydraulic fluid flows through the sequence valve and out through high pressure port 224. The high pressure port 224 does not restrict the outflow of the relatively low pressure fluid through the sequence valve. However, hydraulic fluid supplied to port 224 is not allowed to flow through the sequence valve from port 224 unless such fluid is at a relatively high pressure, a pressure of approximately 1950 psi. The high pressure fluid that does enter valve 216 through port 224 exits the valve through outlet port 232 and to sump.

Sequence valve 218 is adjusted so that hydraulic fluid is not permitted to enter the valve through high pressure port 226 unless the fluid is at a pressure above about 1950 psi whereupon the fluid flows through the valve and then out through low pressure port 230. In addition, hydraulic fluid at a relatively low pressure, a pressure of about 1200 psi, is permitted to enter valve 218 through low pressure port 230 and exit the valve through exhaust port 234 which is connected to sump. Sequence valves, such as valves 216 and 218, are widely commercially available. An example of such valves are manufactured by Sterling.

As noted above, hydraulic fluid from manifold outlet ports 210 and 212 is transmitted to sequence valves 216 and 218 through lines 220 and 222. Because line 220 is connected to low pressure inlet port 228 of valve 216, the hydraulic fluid initially flows through this valve and not through valve 218 since the hydraulic fluid must be at a pressure of at least 1950 psi to enter sequence valve 218 through inlet port 226. The hydraulic fluid flowing through sequence valve 216 is routed through line 238 to a port 236 at the upper end of hydraulic cylinder assembly 148 thereby to effect retraction of cylinder rod 154 which, in turn, causes platform 12 to be raised. After the platform 12 has been elevated to the full height permitted by lift cylinder assembly 148, the cylinder "dead heads," thereby increasing the pressure in line 222, extending between manifold 208 and sequence valves 218, to a level sufficient to initiate fluid flow into valve 218 through port 226 and out through low pressure port 230, through line 240 and into platform cylinder assembly 130 through port 242 to extend the cylinder rod 136. As a result, platform movable section 22 is extended outwardly from deck 30 between handrail structures 243 and 244 to overlie and rest on the uppermost step of stairs 26, as shown in FIG. 5. Additionally referring to FIGS. 1 and 4, a support and guide rail 246 is mounted in horizontal orientation on handrail structure 243 to underlie and support the corresponding side edge of platform movable section 22. Also, a support and guide rail 248 is horizontally mounted on handrail structure 244 for underlying and supporting the horizontal section of bracket 140 attached to the forward side edge portion of platform movable section 22. Although handrail structures 243 and 244 and rails 246 and 248 are illustrated as being constructed of tubular material, it is to be understood that these structures and components may be constructed from other types of structural members, such as angle members or channel members.

With the platform movable section 22 in the extended position shown in FIG. 5, the gate 60 may be opened and then the passenger and/or cargo supported by the movable section during transfer from deck 30 to the top of the stairs 20. During this transfer process, platform 12 is maintained in a raised position by lift cylinder assembly 148 which is being held in retracted condition by pressurized hydraulic fluid in line 238. Even if pump 202 is switched off, hydraulic fluid in line 238 is prevented from discharging through sequence valve 216 since the hydraulic fluid is not permitted to enter the sequence valve through high pressure port 224 unless the pressure of the fluid in line 238 is above a preset high pressure level which is higher than the pressure of the fluid in line 238 when platform 12 is in its raised position and fully loaded. It will be appreciated that the use of sequence valves 216 and 218 in the manner described above provides an important safety feature against the accidental lowering of platform 12.

If a failure occurs in line 238, platform 12 is prevented from lowering by virtue of the friction or wedging force existing between cuffs 120 and guide members 90, as discussed above. The wedging action between the cuffs and the guide members is sufficient to prevent the lowering of platform 12 even if in a fully loaded condition. As a further safety feature, a flow restriction valve 250, which is located at the upper lift cylinder port 236, limits the rate at which hydraulic fluid is permitted to pass through the port. Thus, even if line 238 were to fail, such as by bursting, platform 12 will lower at a safe, slow rate of speed.

Once lift 10 has been unloaded, the platform 12 can be retracted, the lift lowered to the position shown in FIG. 4 and gates 60 and 62 opened so that stairs 26 are accessible by passing over platform 12. To this end, a switch, for instance switch 260 mounted on handrail 262, FIG. 1, may be activated to cause the hydraulic pump 202 to supply pressurized hydraulic fluid through outlet port 264 rather than through port 204. The hydraulic fluid from port 264 is transmitted through line 266 and through a tee 268 incorporated into bar 208 in a manner similar to tee 206 described above. Tee 268 includes an inlet port 270 in communication with line 266 and a pair of outlet ports 272 and 274 in communication with lines 276 and 278, respectively. Line 276 is interconnected to a port 280 located at the end of the double-acting platform cylinder assembly 130 at which rod 136 enters and exits the cylinder assembly. Line 278 is interconnected with a port 282 located at the lower end of the double-acting lift cylinder assembly 148.

During the "retract and lower" mode of lift 10, pressurized hydraulic fluid from pump 202 initially flows through line 276 to cause retraction of the platform cylinder assembly 130 which results in a corresponding outflow of hydraulic fluid from the opposite end of the platform cylinder assembly through port 242, from port 242 the discharged hydraulic fluid flows through line 240 and enters sequence valve 218 through low pressure port 230 and then flows to sump through exhaust valve 234. During the retraction of the platform cylinder assembly 130, lift cylinder 18 is held in fully retracted condition by sequence valve 216 which, as discussed above, is adjusted so that the pressure of the hydraulic fluid at port 224 must be at a relatively high level to permit the hydraulic fluid to flow through the valve and out through exhaust port 232. This pressure level is higher than exists in line 238 when platform 12 is fully loaded and in a raised position and platform cylinder assembly 130 is being retracted. This relatively high-pressure level is achieved only after platform cylinder assembly 130 has been fully retracted so that the fluid in line 276 is dead headed against the platform cylinder assembly which then results in a buildup of pressure in line 278 sufficient to switch valve 216 so as to permit entry of hydraulic fluid into the lower end of the doubleacting lift cylinder assembly 148 and out the upper end of the cylinder assembly, through line 238, into sequence valve 216 through high pressure inlet port 224 and to sump through exhaust port 232. It will be appreciated that by the above construction of the hydraulic system 28, when the system is switched from the "raise and extension" mode to the "retract and lower" mode, the hydraulic lift cylinder assembly 148 is still maintained in fully retracted position by the sequence valve 216 until the platform 12 has been fully retracted. As a result, there is no partial or momentary lowering of platform 12 when the switchover is made, as is typical in existing lifts of the type of the present invention.

It will be appreciated that the hydraulic pump 202, sequence valves 216 and 218 and associated components can be mounted on the baseplate 92 with lines leading from these components to the manifold 208 and cylinder assemblies 130 and 148. Alternatively, the pump, sequence valves and associated components can be mounted on the carriage 14 thereby to avoid having to utilize long length hydraulic lines.

Lift 10 may be used to lower passengers and/or cargo from, for instance, the top of steps 26 to the ground G by reversing the above procedure. To this end the switch 260 mounted on the handrail 262, FIG. 1, can be used to summon the lift platform 12. The above-discussed safety features and other advantages of lift 10 are also applicable to the operation of the lift when lowering passengers and/or cargo.

Figures 7, 8, 9, 10, 11:
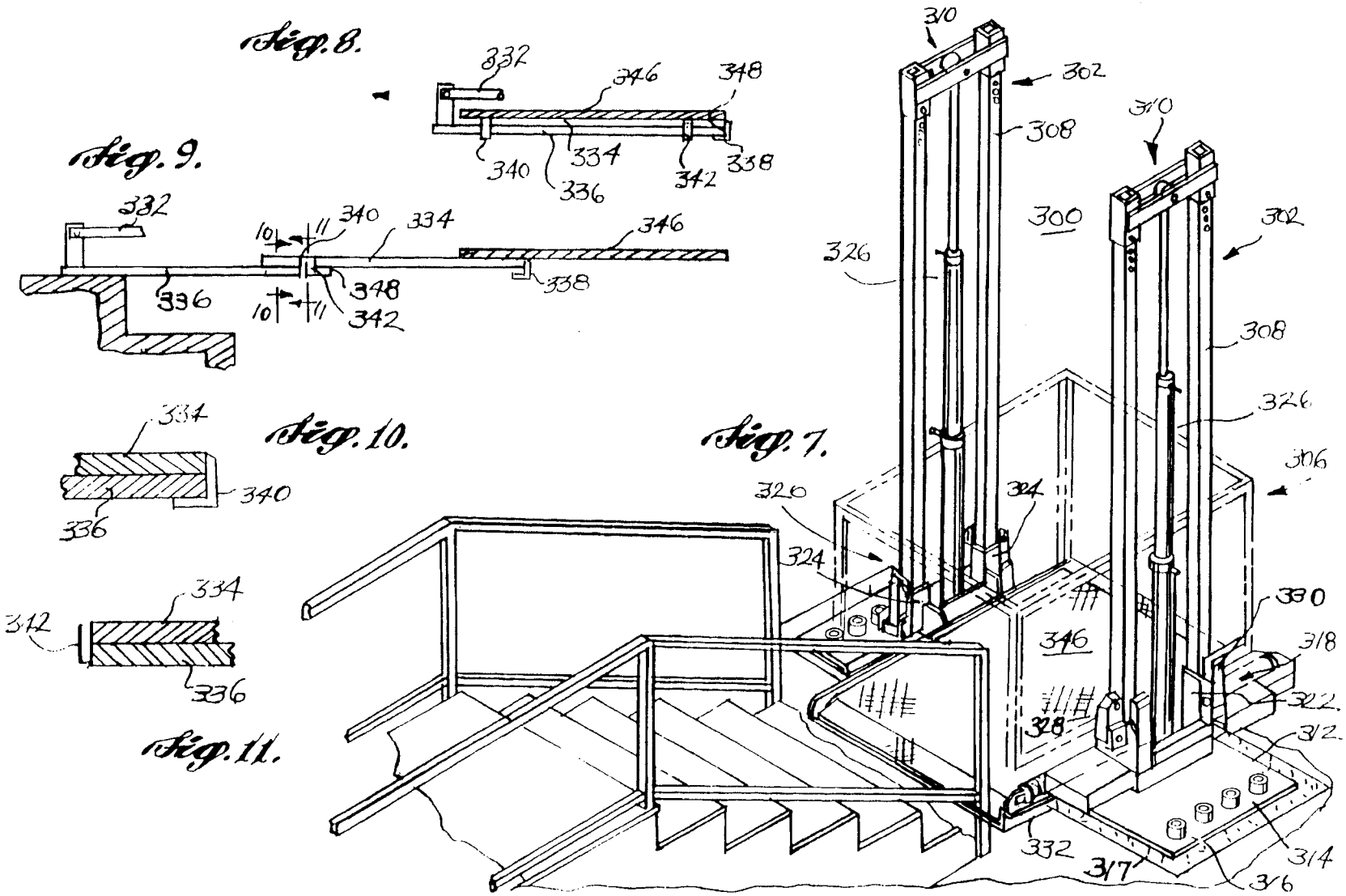
FIG. 7 is an isometric view of an alternative embodiment of the present invention with the lift illustrated in lowered position and the lift platform illustrated in retracted position.
FIG. 8 is a schematic, fragmentary, side elevational view of the lift illustrated in FIG. 7 specifically illustrating the platform in retracted position.
FIG. 9 is a view similar to FIG. 8 specifically illustrating the lift platform in extended position.
FIG. 10 is an enlarged, fragmentary cross-sectional view of a portion of the lift platform shown in FIG. 9, taken substantially along lines 10—10 thereof; and, FIG. 11 is an enlarged, fragmentary cross-sectional view of another portion of the lift platform shown in FIG. 9, taken substantially along lines 11—11 thereof.

In an alternative preferred embodiment of the present invention shown in FIGS. 7, 8 and 9, lift 300 is supported by a pair of mast structures 302 located on opposite sides of platform 306. The use of the two mast structures 302 enables lift 300 to be freestanding rather than being cantilevered from a single mast structure in the manner of lift 10 illustrated in FIGS. 1 through 5. Mast structures 302 are constructed essentially identically to mast structure 16 but of a taller height than mast structure 16. The mast structures 302 include a pair of elongate, spaced apart guide members 308 interconnected at their upper end portions by a crosshead assembly 310. The lower ends of guide members 308 are interconnected by ground engaging baseplates 312. If required for stability based on various factors, such as the maximum lift elevation of platform 302, baseplates 312 may be anchored to the ground with anchor tubes 314 extending downwardly into the ground through collars 316 fixedly secured to baseplate 312. Cross pins 317 maintain the collars in engagement with the anchor tubes 314.

The side portions of platform 306 are secured to carriages 318 and 320 each having a pair of cuffs 322 and 324, respectively, for closely encircling the guide members 308. The carriages 318 and 320 are raised and lowered on the mast structures 302 by linear lift actuators in the form of two-stage, hydraulic cylinder assemblies 326 having their lower ends pinned to carriages 318 and 320 and their upper ends pinned to crosshead assemblies 310 in a manner similar to the attachment of lift actuator 18 in FIGS. 1–5. It will be appreciated that constructing cylinder assemblies 326 in two stages enables the platform 306 to be lifted to a higher elevation than if the cylinder assemblies were constructed from a single stage of the same extended length. It is to be understood, however, that cylinder assemblies 326 could be constructed from more than two stages to achieve an even higher lift elevation of platform 306.

As shown in FIG. 7, carriages 318 and 320 both utilize side roller assemblies 328 and rear roller assemblies 330 similar to the side roller assemblies 170 and the rear roller assemblies 172 shown in FIGS. 1–5. Also, a platform linear actuator, in the form of a hydraulic cylinder assembly 332, is mounted on carriage 318 similarly to the manner in which platform actuator 24 is mounted on carriage 14, see FIGS. 2 and 3. Since a single platform actuator is sufficient for the extension and retraction of platform 306, a platform actuator is not used in conjunction with carriage 320.

To take advantage of the additional lift height of platform 306 relative to platform 12, platform 306 is constructed with two, horizontally movable sections, an upper section 334 and a lower section 336, FIGS. 8–11. An abutment hook 338 extends downwardly from the rearward edge portion of the upper movable section 334 and forwardly to underlie the lower section 336 when the platform 306 is in retracted position. Also, a pair of hook lugs 340 extend downwardly from the forward side edge portions of the platform upper movable section 334 and laterally inwardly to underlie lower section 336. Hook lugs 340 are fixedly attached to the side edge portion of the platform upper movable section 334 by any convenient means, such as by weldments. Corresponding lugs 342 extend upwardly from the side edge portions of the platform lower movable section 336 at a location adjacent the rearward portion of the lower movable section.

The platform movable sections 334 and 336 are extended and retracted by platform cylinder assembly 332, which preferably is of the two-stage type. This enables the cylinder assembly 332 to be extended to the length required to fully extend the platform movable sections 334 and 336 while being short enough in retracted condition to remain within the envelope defined by the perimeter of platform 306. When cylinder assembly 332 is actuated to extend platform 306, the platform lower movable section 336 is slid outwardly from platform deck 346 until lugs 342 abut against corresponding hook lugs 340 on the platform upper movable section 334 whereupon the upper movable section is extended along with the lower movable section. To retract platform 306, the platform cylinder assembly 332 is activated in reverse direction causing the platform lower movable section 336 to move towards deck 346 until the rearward edge 348 of the lower movable section engages against hook 338 whereupon the upper movable section 334 is retracted along with the lower movable section 336. During the sliding movement of lower section 336 relative to upper section 334, the hook lugs 340 maintain the two sections in alignment with each other by guiding the lower section relative to the upper movable section. To facilitate this function of the hook lugs 340, ideally they are not located directly across from each other, but rather are staggered somewhat relative to each other in the fore-and-aft direction along the two side edges of the upper movable section 334.

It will be appreciated that lift 300 provides the same advantages provided by lift 10 with the additional advantages of being freestanding, and capable of reaching the higher lift elevation. It is also to be appreciated that lift 300 could be constructed with mast structures similar to mast structure 16 shown in FIGS. 1–5 if a higher lift elevation is not necessary, in which case platform 306 could be constructed with a single movable section in the manner of platform 12. On the other hand, the lift 300 could be constructed with telescoping guide members 308, for instance, composed of an upper section that includes the crosshead assembly 310 that telescopes downward into a lower section that carries the carriage 318/320. Such telescoping mast assemblies are commonly used on fork lifts.

Moreover, as a further alternative, platform 300 could be constructed with a single mast structure which is capable of raising platform 306 to an increased height over that possible with lift 10 by the use of: a taller mast structure, such as mast structure 302; a lift actuator, such as two-stage cylinder assembly 326; a platform actuator, such as two-stage cylinder assembly 332; and, a platform constructed from upper and lower movable sections, such as movable sections 334 and 336.

As will be apparent to those skilled in the art to which the invention is addressed, the present invention may be embodied in forms other than those specifically disclosed above without departing from the spirit or essential characteristics of the invention. The particular embodiments of connector lifts 10 and 100, described above, are therefore to be considered in all respects as illustrative and not restrictive. The scope of the present invention is as set forth in the appended claims, rather than being limited to the examples of lifts 10 and 300 set forth in the foregoing description.

The embodiments of the invention in which an exclusive property or privilege is claimed are defined as follows:

1. A wheelchair apparatus for transferring wheelchair passengers between different elevations comprising:

(a) a vertically displaceable lift platform having a horizontally movable section extendible therefrom;

(b) a first upright mast assembly;

(c) first carriage means mounting said platform on said first mast assembly for guiding said platform along said first mast assembly;

(d) a first actuator for raising and lowering said platform relative to said first mast assembly;

(e) a second actuator attached to said platform and to said movable section, for extending and retracting said movable section relative to said platform, whereby upon extension of said second actuator, said movable action is extended from said platform to form a substantially coplanar surface with said platform for entrance onto or exit from said platform, and upon retraction of said second actuator said movable section is retracted;

(f) actuator control means operatively connected to said first and second actuators for selectively controlling the movement of said platform and said movable section between a raise and extension sequence wherein said platform is raised and said movable section of the platform is extended, and a retract and lower sequence wherein said platform is lowered and said movable section of the platform is retracted, said sequences resulting from the activation of said first and second actuators;

(g) wherein the actuator control means operatively controls said first and second actuators to raise said platform before extending said movable section of said platform during the raise and extension sequence, and to retract said movable section of the platform before lowering said platform during the retract and lower sequence;

(h) a source of pressurized fluid;

(i) wherein said actuator control means comprise first and second control valves connected in fluid flow communication between said source of pressurized fluid and said first and second actuators;

(j) wherein said first and second control valves during the raise and extension sequence direct pressurized fluid initially to said first actuator to activate said first actuator to raise said platform and then, after said platform has been raised to a desired height, directing pressurized fluid to said second actuator to activate said second actuator to extend said movable section of the platform;

(k) wherein said first and second control valves during the retract and lower sequence direct pressurized fluid initially to said second actuator to activate said second actuator to retract said movable section of the platform while simultaneously preventing fluid from discharging from the first actuator thereby maintaining said platform in raised position, said movable section directing pressurized fluid to said first actuator to lower said platform;

(l) wherein said first control valve is interposed between the source of pressurized fluid and said first actuator and the second control valve is interposed between the source of pressurized fluid d said actuator;

(m) wherein during the raise and extension sequence, said first and second control valves cooperatively direct the pressurized fluid to flow initially through said first control valve in a first direction to first actuator to activate the first actuator to raise said lift platform while simultaneously preventing the pressurized fluid from flowing through said second control valve until said lift platform has been raised to a desired height whereupon the pressurized fluid is directed to flow through said second control valve in a first direction to extend said movable section of the lift platform;

(n) wherein during the retract and lower sequence, said first and second control valves cooperatively direct the pressurized fluid to flow initially to said aid second actuator and from said second actuator and through the second control valve in a second direction thereby to activate said second actuator to react said movable section while simultaneously preventing pressurized fluid from flowing from said first actuator and through said first control valve in a second direction until the movable section has been retracted whereupon pressurized fluid is permitted to flow from the said actuator through said first control valve in a second direction thereby to activate the id actuator to lower said platform;

(o) wherein said first control valve comprises means for directing the pressurized fluid to flow through said first control valve in the first direction and to the first actuator during the raise and extension sequence at a pressure that is lower than the pressure at which fluid is directed to flow through said first control valve in the second direction during the retract and lower sequence; and, (p) wherein said second control valve having means for directing pressurized fluid from flowing from said second actuator and through said second control valve in the second direction during the retract and lower sequence at a pressure that is lower than the pressure at which the fluid is directed to flow in the first direction through said second control valve and to said second control valve and to said second actuator and also at a pressure which is lower than the pressure at which the fluid is directed to flow from said first actuator and through said first control valve in the second direction during the retract and lower sequence.

* * * * *

UNITED STATES PATENT AND TRADEMARK OFFICE

CERTIFICATE OF CORRECTION

PATENT NO. : 5,553,990

DATED : September 10, 1996

INVENTOR(S) : D. Kytola, Sr.

It is certified that error appears in the above-indentified patent and that said Letters Patent is hereby corrected as shown below:

| COLUMN | LINE | |
|---|---|---|
| 12 (Claim 1, | 43 line 18) | After "actuator" insert --,-- |
| 13 (Claim 1, | 21 line 62) | After "fluid" delete the word "d" and insert therefor --and-- |
| 14 (Claim 1, | 11 line 86) | Delete "id" and insert therefor --said-- |

Signed and Sealed this

Seventeenth Day of June, 1997

*Attest:*

*Attesting Officer*

BRUCE LEHMAN

*Commissioner of Patents and Trademarks*